United States Patent [19]

Ebbeson et al.

[11] 4,102,289

[45] Jul. 25, 1978

[54] DEVICE FOR SETTING AND FURLING SAILS

[76] Inventors: Bengt Ebbe Oscar Ebbeson, Järnvägsgatan 8, 302 49 Halmstad; Björn Alvar Wisjö, Nyvangen 1, 302 57 Halmstad, both of Sweden

[21] Appl. No.: 752,916

[22] Filed: Dec. 21, 1976

Related U.S. Application Data

[63] Continuation-in-part of Ser. No. 609,789, Sep. 2, 1975, abandoned.

[30] Foreign Application Priority Data

Sep. 2, 1974 [SE] Sweden ..... 7411067

[51] Int. Cl.[2] ..... B63H 9/10

[52] U.S. Cl. ..... 114/104

[58] Field of Search ..... 114/102, 104, 105; 244/147

[56] References Cited

U.S. PATENT DOCUMENTS

| | | | |
|---|---|---|---|
| 2,595,110 | 4/1952 | Steube et al. | 114/104 |
| 3,310,018 | 3/1967 | Roberts et al. | 114/104 |
| 3,831,541 | 8/1974 | Williams | 114/104 |
| 3,861,343 | 1/1975 | Fretwell | 114/104 |

*Primary Examiner*—Trygve M. Blix
*Assistant Examiner*—Charles E. Frankfort
*Attorney, Agent, or Firm*—Kurt Kelman

[57] ABSTRACT

A device for setting and furling a light sail comprises an elongated nylon sleeve and a substantially rigid, funnel-shaped member having an inner end in substantial alignment with the sleeve and an outwardly flaring outer end. The funnel-shaped member has at least a portion extending from the outer end towards the inner end which defines an entirely smooth and even sliding surface for the sail when furled into the sleeve through the outwardly flaring outer end. The surface of the funnel-shaped member portion is generated by a spherical curve and the inner end lies on a circle generated by an innermost point of the curve whereby none of the funnel-shaped member extends radially inwardly beyond the circle. The inner end of the funnel-shaped member is attached to an end of the sleeve and the funnel-shaped member and the attached sleeve are movable over the sail.

7 Claims, 7 Drawing Figures

DEVICE FOR SETTING AND FURLING SAILS

This is a continuation-in-part of our copending application Ser. No. 609,789, filed Sep. 2, 1975, now abandoned.

The present invention relates to improvements in a device for setting and furling a light sail, especially a spinnaker, of a sail boat having a mast.

A type of sail called a spinnaker is often used in sailing boats. It is of substantially triangular shape, the three corners usually called clews or guys being connected to the rigging and hull of the boat. With few exceptions, the connections consist of a halyard which is led via a block at the mast down to the boat deck, and two lines, so-called sheets or guys, from which, seen from the sail, two bottom corners are in contact with the boat hull, usually also with the help of blocks.

Such a sail is usually set by the halyard which is usually attached to the upper corner, the so-called halyard clew being pulled up into the vicinity of the block attached to the mast. When the sail has been hoisted to a suitable level, both the lower sheet clews are drawn apart by means of the sheets thereto attached. One sheet is usually taken on the windward side of the boat via the horn on a rigged-out boom, a so-called spinnaker boom. When the lower sheet clews are drawn apart, the sail fills with wind. In furling the sail, the procedure as a rule is to release the sheet which is taken via the spinnaker boom horn, at the same time as the halyard is lowered, while the sail is hauled in by means of the other sheet. These simple procedures for setting and downing the spinnaker often cause difficulties in practice. Readying of the sail after downing is also time-consuming, and a certain amount of time must elapse before it can be set again. Attempts have, therefore, been made to provide means which facilitate the practical management of the sail and make setting and furling simpler even under difficult conditions, e.g., a heavy wind and rough sea.

Thus, U.S. Pat. No. 2,595,110 describes a device with an elongated longitudinally collapsible fabric sleeve shaped to be drawn over the spinnaker to furl it, and conversely to be completely drawn off when the spinnaker is to be set. The diameter of the sleeve is so adjusted that it accommodates the sail without difficulty so that the sail is pleated like a bell sash. The length of the sash corresponds to the total length of the sail, which means that, when the sail is taken in, it lies entirely enclosed in the sleeve.

At an appropriately adapted upper end, the sleeve is attached to the top of the mast and the lower end of the sleeve is so constructed that, by means of a line running inside it up to its upper end, and from here back down to the deck, it can be hauled up over the sail when the latter is set. At the lower end, the other end of the halyard is attached with associated means so that the line thereby becomes endless.

The device according to the patent in principle involves an advantageous solution. It is, however, burdened with the drawback that it does not function completely satisfactorily in practice. This applies particularly to the lower end of the sleeve, which should run up and down the sail with the least possible resistance when setting and furling the sail, respectively, without exposing the sail or the sleeve with associated parts to hazardous wear.

According to the patent, the lower end of the sleeve is provided with a device comprised of two assembled coaxial rings, an upper and a lower ring. The end of the sleeve is folded over the lower ring from the inside, and when the sleeve end moves over the sail, the latter will glide over the edge portions of the sleeve, often with very heavy friction. This subjects the halyard to large forces when furling or setting the sail, associated with large wear on it, but above all the edge portion of the sleeve, with the risk of wearing it out. There is the same tendency caused by the fact that the halyard is attached to one side of the lower ring, resulting in twisting of the whole sleeve end when it is taken up or down over the sail.

According to the present invention, these drawbacks are circumvented in a simple and effective manner. This is done with a substantially rigid, funnel-shaped member having an inner end in coaxial alignment with the sleeve and an outwardly flaring outer end. The funnel-shaped member has at least a portion extending from the outer end towards the inner end which defines an entirely smooth and even sliding and gliding surface for the sail when furled into the sleeve through the outwardly flaring outer end. The surface of the funnel-shaped member portion is generated by a spherical curve and the inner end lies on a circle generated by an innermost point of the curve whereby none of the funnel-shaped member extends radially inwardly beyond the circle. The device of this invention comprises an elongated longitudinally collapsible sleeve of a thin textile sheet material and one of the sleeve ends is connectable to an upper portion of the mast of a sailing boat. The inner end of the funnel-shaped member is attached to the other sleeve end and means is provided for moving the funnel-shaped member and the attached sleeve over the sail.

A preferred device for attachment to an end of the collapsible sleeve comprises two identical substantially rigid, funnel-shaped members assembled into a detachable unit, each member having an inner end and an outwardly flaring outer end. A portion extends from the outer to the inner end defining an entirely smooth and even gliding and sliding surface for the sail when furled into the sleeve through the outwardly flaring outer end, the surface of the funnel-shaped member being generated by a spherical curve extending over substantially a quarter of a circle and the inner end lying on a circle generated by an innermost point of the curve whereby none of the funnel-shaped member extends radially inwardly beyond the circle. A substantially semi-circular cylindrical flange extends about the inner end and defines a substantially semicircular groove therein. The two funnel-shaped members are assembled coaxially and symmetrically with respect to a median plane extending between the circular inner ends of the members and the cylindrical flanges are symmetrically arranged with respect to a vertical plane passing through the axis of the funnel-shaped members. A respective one of the flanges matingly extends into a respective one of the grooves, and the length of the flanges is such that an annular space remains between the circular inner ends of the members. Fastening elements hold the flanges in the grooves and thus form the two funnel-shaped members into a detachable unit, and a fastening ring is frictionally wedged into the annular space and adapted for attachment to the sleeve end, preferably by folding the end of the sleeve around the ring before it is wedged in the annular space and the two funnel-shaped members are assembled.

The funnel-shaped member of this invention has a smooth, completely rounded surface along which the sail makes substantially tangential contact as it is furled and pulled through the member into the sleeve, the surface finish being most nearly comparable to a bright, polished surface. A preferred material for the funnel-shaped member is a glass fiber reinforced rigid synthetic resin.

With a funnel-shaped member of the shape and surface characteristics of the invention, a light sail will slide linearly along the smooth surface of the member in a generally tangential direction when it is pulled into the sleeve through the member while wind is caught inside the sail and blows it into a generally bulbous shape, as will be explained more fully hereinafter. This smooth gliding motion of the sail reduces the required tensional forces applied to the sail to pull it into the sleeve to a minimum, thus greatly reducing wear of the sail.

The above and other objects, advantages and features of the present invention will become more apparent from the following detailed description of certain now preferred embodiments thereof, taken in conjunction with the accompanying drawing wherein FIG. 1 shows a side elevational view of the fore part of a sailing boat having a mast and a pinnaker furled with the device of this invention;

Figure 1:
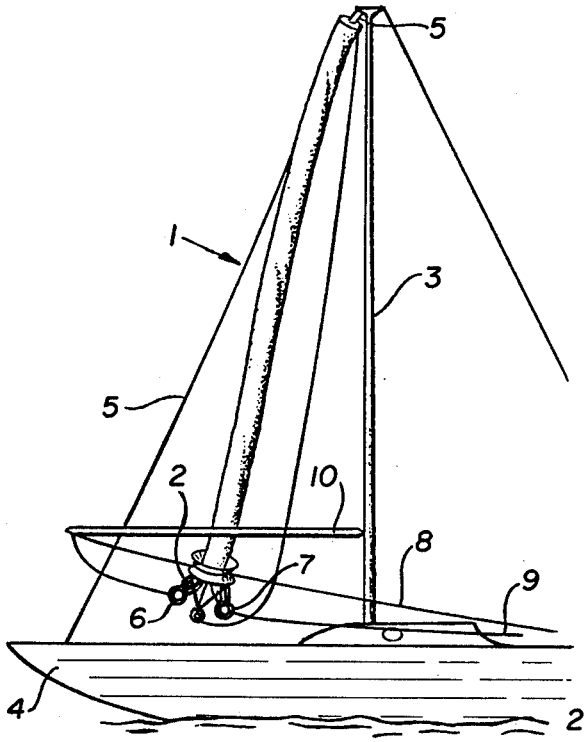

FIG. 1 shows device 1 for setting and furling spinnaker 2 having an upper end connected to mast 3 fixed on hull 4 of a sailing boat. The upper corner of the spinnaker is similarly attached to the top of mast 3, which is provided with forward stay 5. Two sheets 8, 9 are attached to the lower sheet clews 6, 7 of spinnaker 2, sheet 8 running off the horn of a spinnaker boom 10.

Figure 2:
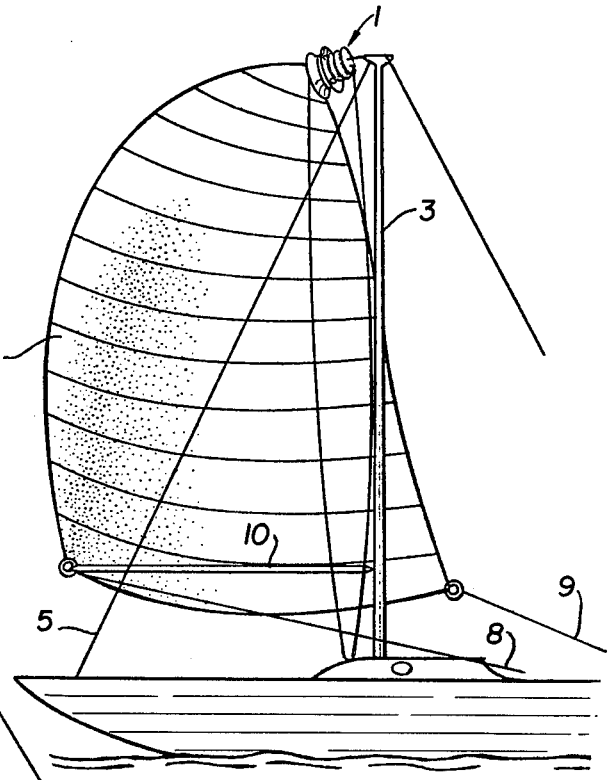
FIG. 2 is a like view, with the spinnaker set to full sail and the sail furling device in completely hoisted position.
Figure 3:
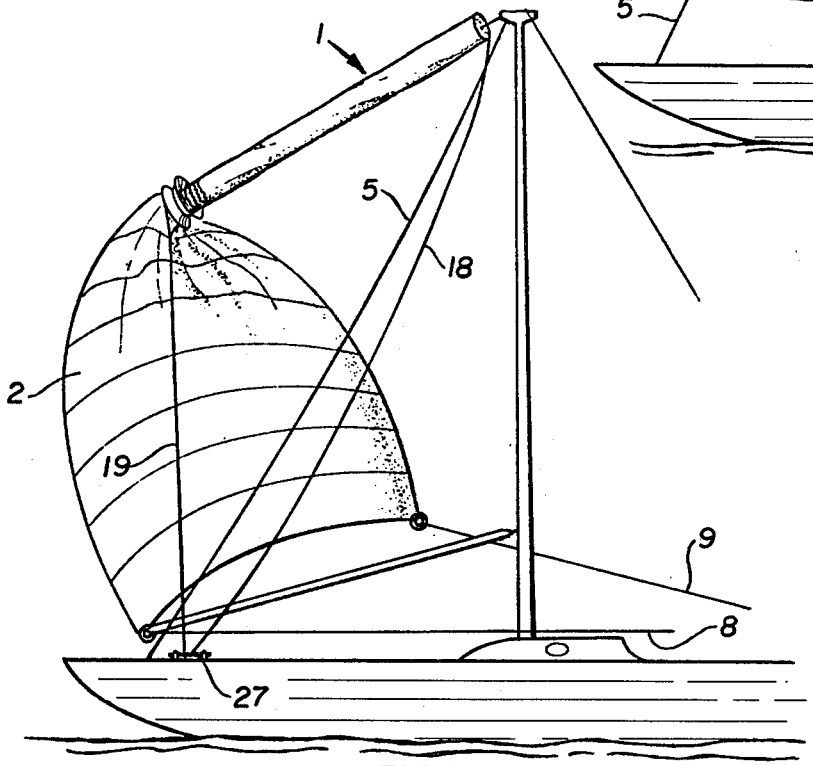
FIG. 3 is a like view, with the spinnaker reefed to a reduced sail area and the device in partly hoisted position.

FIG. 1 shows setting and furling device 1, which is more fully described hereinafter, in use with a completely furled spinnaker 2, the sail area of the latter being reduced to an absolute minimum. FIG. 2 shows device 1 in use with a fully set spinnaker 2, the device in its entirety being hauled up to the top of mast 3, so that the full sail area of spinnaker 2 is obtained. FIG. 3 shows a working position for device 1 in which only a part of spinnaker 2 is uncovered, which means that spinnaker 2 is in action with a reduced sail area or is in the process of being furled.

Figure 4:
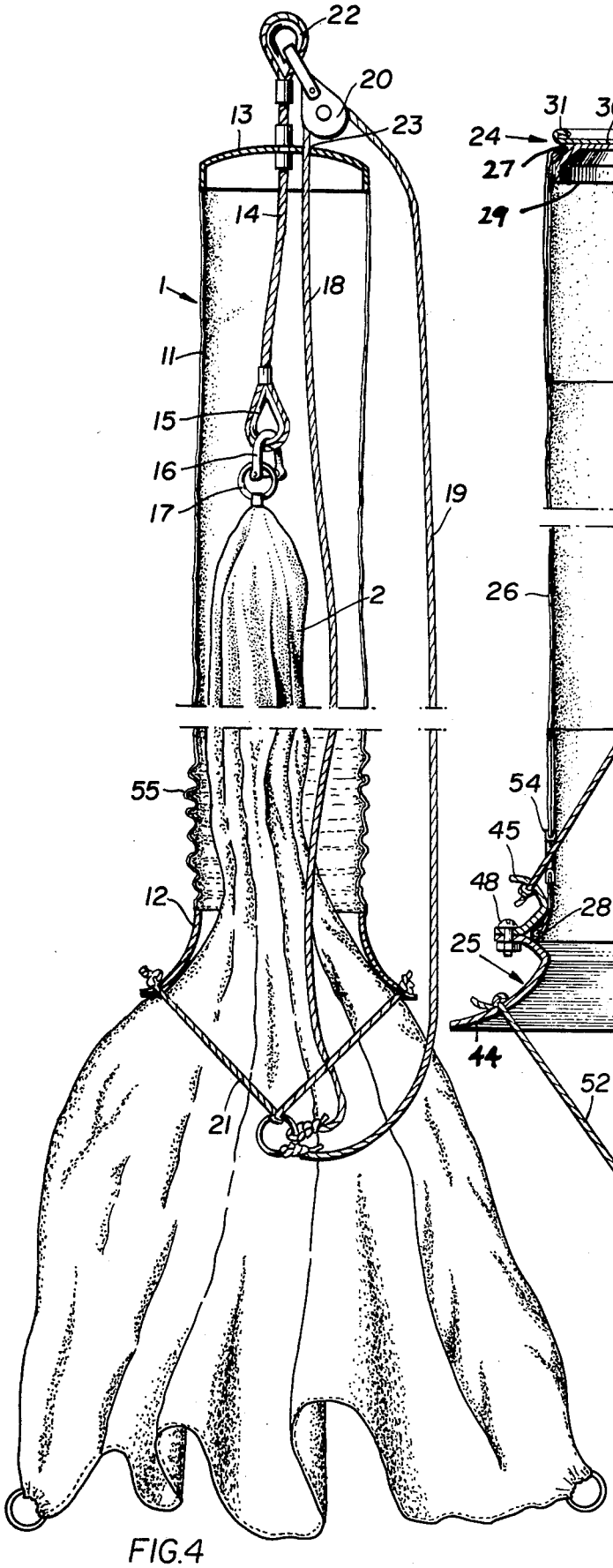
FIG. 4 is an enlarged axial section of one embodiment of the device, with the spinnaker shown in side view as it is pulled into the sleeve of the device through its funnel-shaped member.

FIG. 4 shows the furling and setting device 1, comprising elongated, tubular sleeve 11 of thin but at the same time strong foldable textile material, e.g., nylon fabric with substantially rigid, lower end funnel-shaped member 12 and a similarly stiff upper end part 13. As may be appreciated from FIG. 4, member 12 is shaped as an outwardly smoothly diverging funnel. It is suitably made from a light and strong material, e.g., glass fiber reinforced polyester. The interior surface of funnel-shaped member 12 has a very high finish which is most nearly to be compared with the finish of a polished surface. Sleeve 11, as can be seen from FIG. 4, is placed with an outside surface against member 12, and attached to it by gluing or other method of attachment.

The upper end part 13 has the shape of a cup facing the interior of sleeve 11, and can also be made from glass fiber reinforced polyester or pressed from sheet, e.g., stainless steel. According to FIG. 4, sleeve 11 is attached on the outside of the upper end part 13 by gluing, for example.

FIG. 4 shows how sleeve 11 is drawn over spinnaker 2, which is thereby folded so that it can pass through the interior of sleeve 11 without difficulty. An upper clew 17 of spinnaker 2 is connected to a halyard by means of shackle 16, eyelet 15, line 14 and eyelet 22, with the latter as point of attachment for hoisting to the top of mast 3. The upper end part 13 of sleeve 11 is also fixedly attached to an upper portion of line 14.

A halyard for hoisting and lowering sleeve 11 over spinnaker 2 is arranged in the form of a hoisting part 18 and a lowering part 19 of the same line running over a block 20 which, in the embodiment shown in FIG. 4, is united with eyelet 22 by means of a clevis. The lower ends of hoisting part 18 and lowering part 19 are joined to each other by a crowfoot 21 attached to member 12 in a manner shown in FIG. 4. To lower sleeve 11 over spinnaker 2, i.e., to pull in the latter, crowfoot 21 is pulled downwards and assumes the position shown in FIG. 4. When hoisting sleeve 11 over spinnaker 2, i.e., when setting the latter, crowfoot 21 will be facing the interior of the sleeve. It is clearly seen from FIG. 4 that hoisting part 18 and lowering part 19 commonly form an endless line which freely passes through hole 23 in the upper end part 13 into sleeve 11.

When hoisting sleeve 11 over spinnaker 2, i.e., when pulling the sleeve over the spinnaker or pulling the spinnaker into the sleeve, there is a tendency, due to some unavoidable frictional forces between contacting parts and possibly also because of static electricity developing between contacting portions of the nylon sail and the synthetic resin portions of the furling device, i.e., the collapsible nylon sleeve and/or the polyester funnel-shaped member, for sleeve 11 to be wrinkled heavily immediately adjacent funnel-shaped member 12, as shown by corrugations 55. If the nylon spinnaker would be in substantial contact with this corrugated end portion 55 of nylon sleeve 11, strong frictional forces and static electricity would develop at this point to hold the thin nylon spinnaker in frictional engagement with the corrugated sleeve end portion, thus interfering with the efficient operation of the device. As shown in FIG. 4, such contact between the spinnaker and the corrugated end portion of the collapsible sleeve is avoided by the particular geometry of funnel-shaped member 12. With a smooth sliding and gliding surface generated by a spherical curve and the inner end of the funnel-shaped member lying on a circle generated by an immermost point of the curve, whereby none of funnel-shaped member 12 extends radially inwardly beyond the circle for possible contact with the furled spinnaker, spinnaker 2 will only make substantially linear contact with the gliding surface, moving tangentially therealong into sleeve 11 and out of contact with corrugated sleeve end portion 55, even though the lower portion of the spinnaker still unfurled will be blown into the illustrated bulbous shape by the wind caught therein during the furling operation. This tangential gliding movement constitutes an important advantage of the funnel-shaped member of the disclosed configuration and could not be obtained if the funnel-shaped member were curved substantially exponentially, as shown, for example, in the furling device of U.S. Pat. No. 3,310,018.

The tendency of sail 2 during the furling operation to stick to the funnel-shaped member and the corrugated end portion of the sleeve may be further decreased and entirely eliminated by reinforcing sleeve 11 adjacent member 12, either by doubling-up the sleeve fabric or by using a heavier sheet material. The corresponding measure may also be taken at the upper end part 13. There is the risk here that sleeve 11 is pulled upwards by hoisting part 18, due to friction. In unfavorable cases, it can then happen that a portion of sleeve 11 lies tight against hoisting part 18 resulting in the sleeve twisting itself around the latter and forcing its way together with hoisting part 18 into hole 23 in upper end part 13. The portion of sleeve 11 which is jammed in this way can then be damaged and even worn away to a hole. For obvious reasons there must be no such risk, and about 0.5 m of the sleeve adjacent the end part 13 is therefore reinforced with double or more thicknesses of fabric. An even more advantageous solution is for an inner sleeve of, for example, five times as thick material as sleeve 11 and with a length of about 0.5 m, to be sewn inside sleeve 11, forming together therewith an end portion which is fastened to end part 13. These measures are not especially indicated in FIG. 4 but may be seen from FIG. 5.

Figure 5:
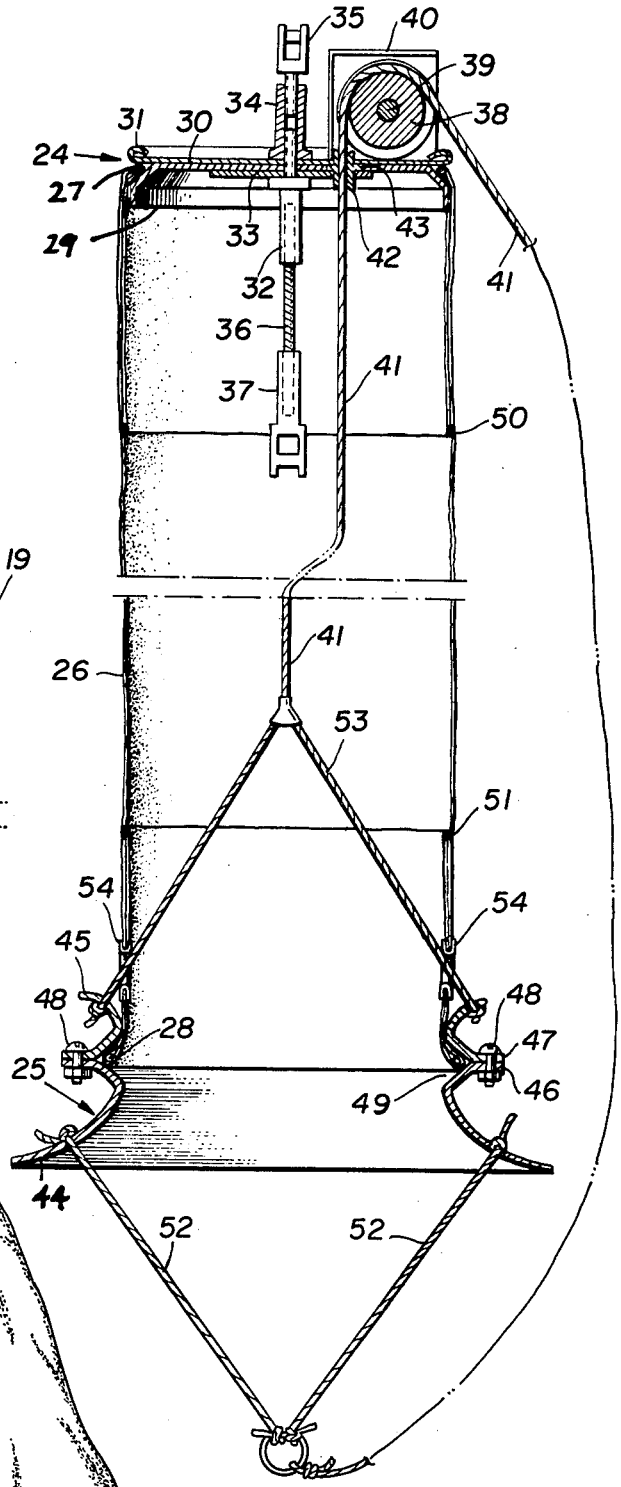
FIG. 5 is an enlarged axial section of another embodiment of the device, without the sail, FIGS. 4 and 5 also showing the means for moving the funnel-shaped member and the attached sleeve over the sail, and FIG. 5 illustrating one embodiment of a particular means for attaching the inner end of the funnel-shaped member to the other end of the sleeve.

FIG. 5 shows advantageous embodiments of attachment means for both sleeve ends, the upper end attachment means in FIG. 5 being generally designated 24, and the lower end funnel-shaped member being generally designated 25. A common feature for these structures is that a sleeve 26 is folded over rings 27, 28 at its respective ends, the rings27, 28 being clamped between two parts of the attachment means. Attachment means 24 comprises cup-shaped part 29 with its open end towards the interior of sleeve 26, preferably made from glass fiber reinforced polyester, and plate 30 mounted on it, suitably of stainless steel sheet, with a turned-over edge 31, parts 29, 30 being clamped together by a centrally mounted threaded and flanged retainer 32, with a spreading washer 33 and a threaded sleeve 34. A fork 35 is threaded into the latter, which, by means of a clevis (not shown), forms the connecting point with the top of mast 3. To retainer 32 there is also rigidly attached stainless steel rod 36 to which fork 37 is also rigidly attached for connecting upper clew 17 to spinnaker 2.

Rigidly attached to plate 30 there is a housing 40 of stainless steel sheet, accommodating sheave 38 mounted on a journal pin 31, housing 40 being made so that halyard 41 for the lower end member 25 cannot jump sheave 38. An inner part of halyard 41 is taken through a guiding sleeve 42 made from non-corroding material, there being a flange 43 for keeping guiding sleeve 42 between plate 30 and spreading washer 33.

The lower end member 25 consists, analogously to the embodiment of FIG. 4, of an outwardly evenly diverging funnel-shaped member 44 of the previously described geometry and smooth gliding surface, and an upper part 45 mounted for connection to it, similarly evenly funnel-shaped outwardly. The parts 44, 45 are provided with annular flanges 46, 47 jointed together with screws 48. An inward V-shaped groove 49 is formed between flanges 46, 47 to provide a seating for ring 28.

The rings 27, 28 are preferably from rustless material and FIG. 5 shows how the sleeve 26 is laid around rings 27, 28 at the end portions and joined together with seams 50, 51, for example, whereby a length of about 0.5 m on sleeve 26 is formed with a double wall. The heretofore mentioned extra stiffening of the end portions of the sleeve 26 is thereby achieved for counteracting too heavy a formation of creases.

In relation to upper end portion 24 it is, as has been previously mentioned, especially advantageous to reinforce the sleeve 26 at the attachment to tend portion 24 for a length of about 0.5 m with an inner sleeve of a material which is, for example, five times as thick as the material in sleeve 26.

At outer end portions of parts 44, 45, which are made from molded elements of preferably glass fiber reinforced polyester, are fastened a lower crowfoot 52 which is connected to a first end of halyard 41 and a second crowfoot 53 which is in turn joined together with a second end of halyard 41. By this arrangement is further ensured that the lower end member 25, on being displaced over spinnaker 2, will move without twisting, eliminating the earlier changing of position (upwards/-downwards), which is unavoidable with only one crowfoot.

A further contributing effect hereto is that upper crowfoot 53 runs through eyelets 54 which are inserted in the double walled portion of the sleeve 26. The crowfoot 53 will in this way form a kind of guide for this portion and completely prevent the sleeve 26 from turning insideout and being carried down through the lower end member 25.

Figure 6:
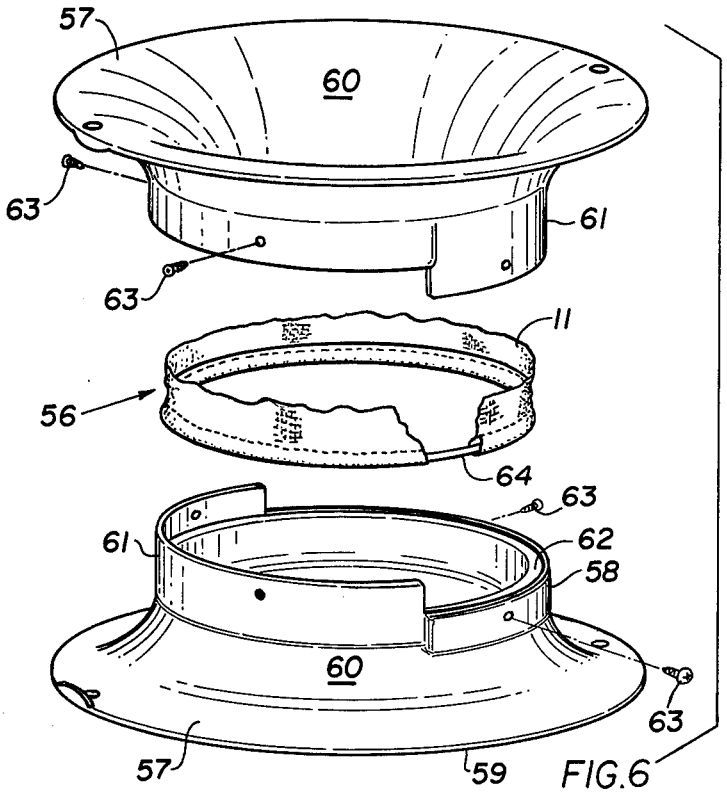
FIG. 6 is an exploded perspective view of a preferred embodiment.

FIG. 6 illustrates, in an exploded view showing the funnel-shaped member and sleeve attachment means in disassembled condition, a preferred embodiment of device 56 for attachment to an end of an elongated longitudinally collapsible sleeve of a thin textile sheet material for furling a light sail into the sleeve. The illustrated device comprises two identical substantially rigid, funnel-shaped members 57. Each member 57 has inner end 58 and outer end 59. Funnel-shaped member portion 60 extends from the outer to the inner end and defines, as in the other embodiments previously described. an entirely smooth and even sliding and gliding surface for the sail (not shown in this figure) when furled into sleeve 11 through outwardly flaring end 59. The surface is generated by a spherical curve extending over substantially a quarter of a circle and the inner end lies on a circle generated by an innermost point of the curve whereby none of the funnel-shaped member extends radially inwardly beyond the circle. Substantially semi-circular cylindrical flange 61 extends about the inner end and defines substantially semi-circular groove 62 therein.

Figure 7:
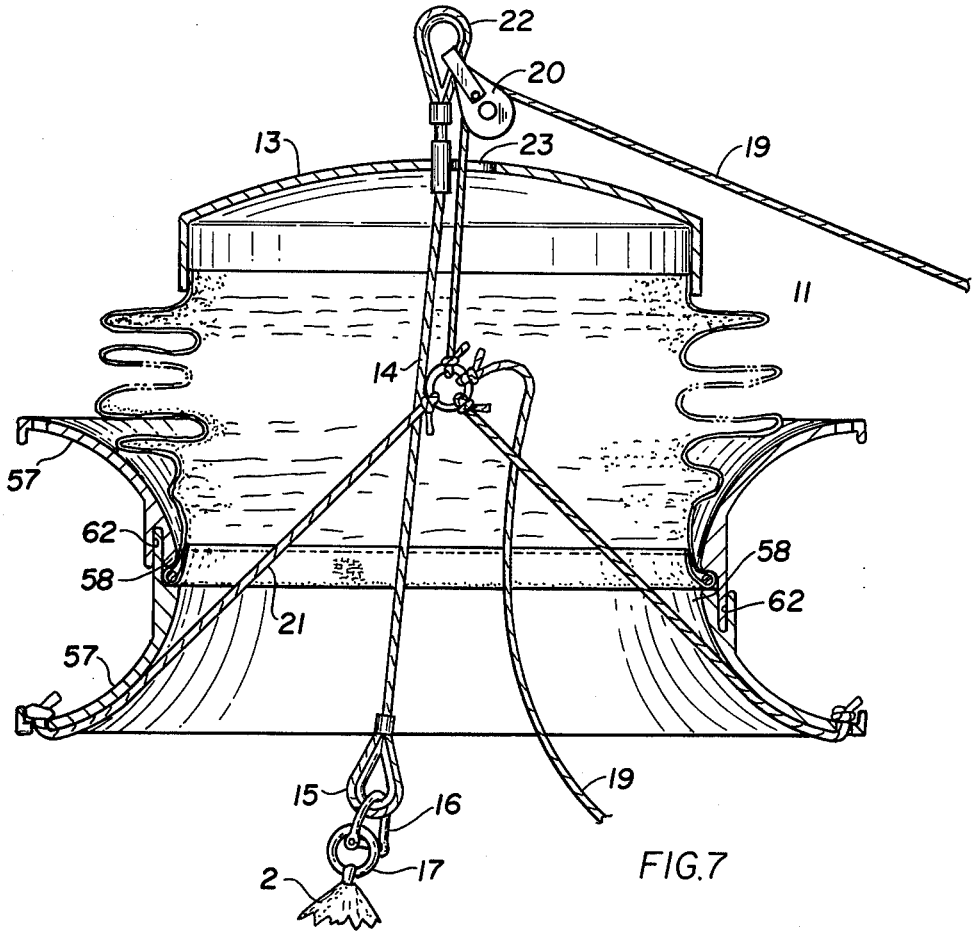
FIG. 7 is an enlarged axial section of the embodiment of FIG. 6, with the collapsible sleeve attached and in collapsed position.

As will be appreciated from the view of FIG. 6, which shows the parts ready for assembly, and more particularly from FIG. 7, which shows the assembled device, twin funnel-shaped members 57 are coaxially assembled into detachable unit 56 symmetrically with respect to a median horizontal plane extending between circular inner ends 58 of members 57. When assembled, cylindrical flanges 61 are symmetrically arranged with respect to a vertical plane passing through the axis of the funnel-shaped members, a respective one of flanges 61 mating extending into a respective one of grooves 62. The length of the flanges is such that an annular space remains between circular inner ends 58 of members 57. Fastening elements illustrated as screws 63 hold flanges 61 engaged in grooves 62 and thus form the two funnel-shaped members into detachable unit 56. Fastening ring 64 is frictionally wedged into the annular space between the inner ends of members 57 and the end of sleeve 11 is folded over the ring for attachment.

FIG. 7 shows the device in assembled condition, like reference numerals designating like parts functioning in the same manner as described hereinabove in connection with FIG. 4. The device is shown in use with a fully set spinnaker 2, as illustrated in FIG. 2, wherein sleeve 11 is collapsed. As shown, in the collapsed condition, the folded sleeve is received in upper funnel-shaped member 57 which thus serves as a storage receptacle for sleeve 11 while it is collapsed and the device is not in use.

What is claimed is:

1. A device for attachment to an end of an elongated longitudinally collapsible sleeve of a thin textile sheet material for furling a light sail into the sleeve, the device comprising (a) two identical substantially rigid, funnel-shaped members assembled into a detachable unit, each member having
  (1) an inner end,
  (2) an outwardly flaring outer end,
  (3) a portion extending from the outer to the inner end, the funnel-shaped member portion defining an entirely smooth and even sliding and gliding surface for the sail when furled into the sleeve through the outwardly flaring end, the surface of the portion being generated by a spherical curve extending over substantially a quarter of a circle and the inner end lying on a circle generated by an innermost point of said curve whereby none of the funnel-shaped member extends radially inwardly beyond the circle, and
  (4) a substantially semi-circular cylindrical flange extending about the inner end and defining a substantially semi-circular groove therein, the two funnel-shaped members being assembled coaxially and symmetrically with respect to a median plane extending between the circular inner ends of the members and the cylindrical flanges being symmetrically arranged with respect to a vertical plane passing through the axis of the funnel-shaped members, a respective one of the flanges matingly extending into a respective one of the grooves, and the length of the flanges being such that an annular space remains between the circular inner ends of the members, (b) fastening elements holding the flanges in the grooves and thus forming the two funnel-shaped members into the detachable unit, and (c) a fastening ring frictionally wedged into the annular space and adapted for attachment to the sleeve end.

2. A device for setting and furling a light sail of a sailing boat having a mast, the device comprising (a) an elongated longitudinally collapsible sleeve of a thin textile sheet material, the sleeve having two ends,
  (1) one of the sleeve ends being connectable to an upper portion of the mast, (b) a substantially rigid, funnel-shaped member having an inner end in coaxial alignment with the sleeve and an outwardly flaring outer end,
  (1) the funnel-shaped member having at least a portion extending from the outer end towards the inner end which defines an entirely smooth and even sliding and gliding surface for the sail when furled into the sleeve through the outwardly flaring outer end, the surface of the funnel-shaped member portion being generated by a spherical curve and the inner end lying on a circle generated by an innermost point of said curve whereby none of the funnel-shaped member extends radially inwardly beyond the circle, (c) means for attaching the inner end of the funnel-shaped member to the other end of the sleeve, said attaching means comprising
  (1) an inwardly flaring funnel-shaped part substantially coaxial with the sleeve and the funnel-shaped member,
  (2) respective mating flanges extending radially outwardly from the inner end of the funnels-shaped member and the funnel-shaped part, the flanges defining an inwardly facing V-groove,
  (3) fastening elements joining the flanges to connect the funnel-shaped member to the funnel-shaped part, and
  (4) a ring seated in the V-groove, the other end of the sleeve being folded over the ring and attached to an adjacent portion of the sleeve, and (d) means for moving the funnel-shaped member and the attached sleeve over the sail.

3. The device of claim 2, wherein the funnel-shaped member and the funnel-shaped part are of glass fiber reinforced polyester.

4. The device of claim 2, wherein the means for moving the funnel-shaped member and the attached sleeve over the sail comprises a lower crowfoot attached to the flaring outer end of the funnel-shaped member, an upper crowfoot attached to the funnel-shaped part, the upper crowfoot passing into the interior of the sleeve through openings therein, and a halyard attached to the crowfeet for respectively hoisting the funnel-shaped member to set the sail and lowering the funnel-shaped member over the sail to furl the sail.

5. A device for setting and furling a light sail of a sailing boat having a mast, the device comprising (a) an elongated longitudinally collapsible sleeve of a thin textile sheet material, the sleeve having two ends, (b) an attachment means connecting one of the sleeve ends to the upper mast portion, the attachment means comprising
  (1) a cup-shaped part coaxial with the one sleeve end and extending thereinto,
  (2) a plate mounted on the cup-shaped part, the cup-shaped part and the plate defining a circumferential groove therebetween,
  (3) a threaded retainer threadedly engaging a threaded sleeve centrally clamping the plate to the cup-shaped part, and
  (4) a ring seated in the groove, the one sleeve end being folded over the ring and attached to an adjacent portion of the sleeve, (c) a substantially rigid, funnel-shaped member having an inner end in coaxial alignment with the sleeve and an outwardly flaring outer end, (1) the funnel-shaped member having at least a portion extending from the outer end towards the inner end which defines an entirely smooth and even sliding and gliding surface for the sail when furled into the sleeve through the outwardly flaring outer end, the surface of the funnel-shaped member portion being generated by a spherical curve and the inner end lying on a circle generated by an innermost point of said curve whereby none of the funnel-shaped member extends radially inwardly beyond the circle, (d) means for attaching the inner end of the funnel-shaped member to the other end of the sleeve, and (e) means for moving the funnel-shaped member and the attached sleeve over the sail.

6. The device of claim 5, wherein the cup-shaped part is of glass fiber reinforced polyester.

7. A device of setting and furling a light sail of a sailing boat having a mast, the device comprising (a) an elongated longitudinally collapsible sleeve of a thin textile sheet material, the sleeve having two ends, (1) one of the sleeve ends being connectible to an upper portion of the mast, (b) a substantially rigid, funnel-shaped member having an inner end in coaxial alignment with the sleeve and an outwardly flaring outer end.

(1) the funnel-shaped member having a portion extending from the outer to the inner end thereof and defining an entirely smooth and even sliding and gliding surface substantially a quarter of a circle for the sail when furled into the sleeve through the outwardly flaring outer end, the surface of the funnel-shaped member portion being generated by a spherical curve and the inner end lying on a circle generated by an innermost point of said curve whereby none of the funnel-shaped member extends radially inwardly beyond the circle, (c) means for attaching the inner end of the funnel-shaped member to the other end of the sleeve, said attaching means comprising (1) another identical funnel-shaped member, each of the funnel-shaped members comprising a substantially semi-circular cylindrical flange extending about the inner end and defining a substantially semi-circular groove therein, the two funnel-shaped members being assembled coaxially and symmetrically with respect to a median plane extending between the circular inner ends of the members and the cylindrical flanges of the funnel-shaped members being symmetrically arranged with respect to a vertical plane passing through the axis of the funnel-shaped members, a respective one of the cylindrical flanges matingly extending into a respective one of the grooves, and the length of the cylindrical flanges being such that an annular space remains between the circular inner ends of the members, fastening elements holding the flanges in the grooves and thus forming the two funnel-shaped members into a detachable unit, and a fastening ring frictionally wedged into the annular space, the other end of the sleeve being attached to the ring, and (d) means for moving the funnel-shaped members and the attached sleeve over the sail.

* * * * *